US007028449B2

(12) United States Patent
Salvoni

(10) Patent No.: US 7,028,449 B2
(45) Date of Patent: Apr. 18, 2006

(54) SEALABLE PACKAGING CONTAINER, PACKAGING MACHINE AND METHOD OF SEALING THE PACKAGING CONTAINER

(75) Inventor: Paolo Salvoni, Corte Franca (IT)

(73) Assignee: CFS Palazzolo, Corte Franca (IT)

( * ) Notice: Subject to any disclaimer, the term of this patent is extended or adjusted under 35 U.S.C. 154(b) by 39 days.

(21) Appl. No.: 10/664,753

(22) Filed: Sep. 18, 2003

(65) Prior Publication Data

US 2005/0247593 A1 Nov. 10, 2005

(30) Foreign Application Priority Data

Sep. 20, 2002 (EP) ..... 02021022

(51) Int. Cl.
*B65B 31/00* (2006.01)

(52) U.S. Cl. ..... 53/510; 53/373.7

(58) Field of Classification Search ..... 53/432, 53/468, 510, 373.2, 373.7
See application file for complete search history.

(56) References Cited

U.S. PATENT DOCUMENTS

| | | | | |
|---|---|---|---|---|
| 1,992,556 | A * | 2/1935 | Tone | 53/432 |
| 3,384,263 | A | 5/1968 | Bernstein | 220/60 |
| 4,154,044 | A * | 5/1979 | Lang | 53/510 |
| 4,221,102 | A | 9/1980 | Lang et al. | 53/96 |
| 4,409,252 | A | 10/1983 | Buschkens et al. | 426/396 |
| 4,687,117 | A | 8/1987 | Terauds | 220/306 |
| 4,707,213 | A * | 11/1987 | Mohr et al. | 53/510 |
| 4,809,486 | A * | 3/1989 | Chanel | 53/510 |
| 4,909,022 | A * | 3/1990 | Kubis et al. | 53/510 |
| 4,982,555 | A * | 1/1991 | Ingemann | 53/510 |
| 5,071,667 | A * | 12/1991 | Grune et al. | 53/510 |
| 5,419,096 | A * | 5/1995 | Gorlich | 53/510 |
| 5,428,943 | A * | 7/1995 | Balcombe | 53/432 |
| 5,509,252 | A * | 4/1996 | Gorlich | 53/510 |
| 5,555,705 | A * | 9/1996 | Balcombe | 53/432 |
| 5,702,743 | A | 12/1997 | Wells | 426/129 |
| 6,694,709 | B1 * | 2/2004 | Takahashi et al. | 53/510 |

FOREIGN PATENT DOCUMENTS

| | | |
|---|---|---|
| EP | 0 214 372 | 4/1986 |
| JP | 04044926 | 2/1992 |
| WO | WO 00/15431 | 3/2000 |

OTHER PUBLICATIONS

English Translation of the Abstract Concerning EP Patent 0 214 372.

* cited by examiner

*Primary Examiner*—Louis Huynh
(74) *Attorney, Agent, or Firm*—Perman & Green, LLP

(57) ABSTRACT

A packaging machine for sealing a packaging container having a lid and a tray comprising an upper part and a lower part arranged vertically moveable against each other, at least three vertical pins mounted on springs for opening a packaging container by lifting the lid off of the tray, evacuating mechanism for exchanging gas within the packaging container and sealing mechanism for sealing the lid to the tray.

8 Claims, 7 Drawing Sheets

SEALABLE PACKAGING CONTAINER, PACKAGING MACHINE AND METHOD OF SEALING THE PACKAGING CONTAINER

BACKGROUND OF THE INVENTION

The invention relates to a sealable packaging container comprising a packaging tray and a packaging lid each having a circumferential area. The invention further relates to a packaging machine having an upper part and a lower part arranged vertically moveable against each other. Finally the invention relates to a method of evacuating and sealing a packaging container in a packaging machine.

Sealable packaging containers comprising a packaging tray and a packaging lid are well known state of the art. The containers are usually produced by thermoforming of a multilayer plastic film wherein a tray and a lid are formed in different dies. Subsequently, the containers are filled and, particularly when serving as containers for food and the like, evacuated or optionally filled with a gas or a gas mixture and finally sealed.

The containers are usually evacuated through openings drilled into the container which are subsequently relocked. This method of evacuating and sealing containers known in prior art is thus costly and in many cases incomplete.

It was therefore an object of the invention to develop a sealable container which can be opened, evacuated and sealed in one single workstation, a packaging machine for evacuating and sealing a container in one single chamber and a method of evacuating and sealing a sealable container which does not have the disadvantages of prior art.

SUMMARY OF THE INVENTION

The sealable packaging container according to the invention comprises a tray and a lid each having an essentially horizontal circumferential area whereas at least in some parts the circumferential area of the lid is larger than the area of the tray. Using this constitution of the container it is possible to lift off at least parts of the lid from the tray by using respective means for this purpose arranged inside the packaging machine. The circumferential area can also be the sealing area. The skilled person understands that the container according to the invention does not have to be opened above its whole circumference. For evacuation and optionally exchanging gas inside the container it is just necessary to open a part of the circumference of the container, especially by flapping the lid from the tray about an axis which is parallel to a lateral edge of the container.

A packaging tray according to the present invention is any packaging tray familiar to the person skilled in the art which is produced from a thermoplastic and dimensionally stable single- or multi-layer film, preferably a film as conventionally used for the packaging of foods.

The invention discloses a packaging container which is inexpensive to produce and easy to handle. The packaging container according to the invention can automatically be evacuated, optionally filled with another gas, and finally sealed in one single working chamber.

In a first preferred embodiment of the invention the circumferential area of the tray contains at least three openings. In a more preferred embodiment of the invention the circumferential area of the tray contains four openings, preferably positioned in the corners of an essentially rectangular sealing package. This preferred embodiment permits the through pins to be directed through the openings and to lift off the lid from the tray. The advantage of this preferred embodiment is that no part of the lid is protruding from the tray. The container is thus compact and easy to handle.

In another preferred embodiment of the invention the circumferential area of the lid is at least in several parts of the essentially horizontal circumference of the container wider than the circumferential area of the tray resulting in an at least partially protruding of the lid's circumferential area in comparison to the circumferential area of the tray. In general but depending on the tray's shape, these protruding parts are distributed on the a perimeter of the container.

In a more preferred embodiment of the sealable packaging container according to the invention these protruding parts of the lid's circumferential area are positioned at the corners of a sealable container.

In a most preferred embodiment of this invention the corners of the circumferential areas are rounded off whereby the roundness of the lid's and the tray's corners do have different radii, the radius of the tray's corner being larger than the radius of the lid's corner.

This most preferred embodiment provides the opportunity to additionally alleviate the opening procedure for the ultimate consumer of the goods stored inside the sealable packaging container.

In a further preferred embodiment of the invention a lug is mounted in each of the regions of at least two preferably diametrically opposing corners. More preferably the lugs are mounted in the region of all corners of the lid or the tray of the sealable packaging container according to the invention. In a most preferred embodiment of the invention those lugs are positioned in the lid and protrude inside the tray of the container when the container is closed. The lugs are serving as guidings for the lid's positioning on the tray.

The advantage of this preferred embodiment of the invention is that the lid is kept secure on top of the tray when being conveyed from the filling station to the sealing station. This is even more useful when the lids are not loaded automatically onto the trays.

Another subject of the present invention is a packaging machine for opening, evacuating and sealing the above described packaging container. By using the packaging machine according to the invention it is possible to open, to evacuate and to seal a sealable packaging container within one single working chamber. The means for opening the container can work at any level of pressure, for example vacuum created in the packaging machine, the container is thus open at any type of ambient and/or modified atmosphere, independently of various pressures or any cycle logic. The machine thus lowers the production costs and the necessary manpower to handle the machine.

The packaging machine according to the invention comprises a lower and an upper part arranged vertically moveable against each other. The machine contains means for sealing the container and means for opening the container by lifting off the lid from the tray. Furthermore the packaging machine according to the invention comprises means for evacuation of the atmosphere inside the container.

The sealing means are mounted in both the upper part of the machine as well as its lower part. The opening means are mounted preferably inside the lower part of the machine. The upper and the lower part both-can be exchanged by parts of the set which are adjusted to different shapes or sizes of the container's tray and lid. In a preferred embodiment of the invention the upper part of the sealing means is moved against the opening means and presses them down until the upper part of the sealing means gets in interaction with the lower part of the sealing means.

In a preferred embodiment of the invention the packaging machine according to the invention comprises a receptacle to insert the container's tray. In this preferred embodiment the opening means are arranged around this receptacle in the lower part of the packaging machine. This preferred embodiment allows an automatic centring of the tray and ensures the effective work of. both the sealing and the opening means.

The means for opening the container according to the present invention comprise all possible means which are able to act vertically upwards onto those parts of the lid's circumferential area which protrude about the circumferential area of the tray. These means can be through pins put through openings provided in the tray's circumferential area. In a preferred embodiment of the invention the means are preferably at least three, more preferably four pins that are guided on the periphery of the tray's circumferential area and lift off the lid from the tray when the container's position is lowered inside the packaging machine according to the invention. A skilled person understands that the number of pins is not restricted to a minimum or a maximum quantity. The number of pins has just to allow a stable and secure lift off operation. A person skilled in the art also understands that the opening means, particularly the pins can also be lifted to vertically remove the lid from the tray, that the lid can be lifted off from the tray as well when the lid is kept in a fixed position and the tray is moved downwards or that a combination of both working steps takes place.

In a further preferred embodiment of the invention the means for opening the packaging container are each mounted on top of spring elements. In this preferred embodiment the force executed by the sealing means acts on top of the opening means and compresses the spring elements. One advantage of this preferred embodiment of the invention is that the sealing means are able to press down the opening means and to get in contact with the sealing area by executing one single movement. Furthermore the opening means do not have to effect a special movement which has to be coordinated with the movement of the sealing means.

In another preferred embodiment the packaging machine according to the invention additionally comprises means for exchanging the gas atmosphere inside the container. This more preferred embodiment provides the opportunity to exchange the air inside the container by an inert gas or an inert gas mixture. After the gas exchange the container is sealed and the gas mixture is held inside the packaging container. The gas exchange means can, as well as the sealing means, be all respective means familiar to the skilled person.

The advantage of this gas exchange is that the packaging machine according to the invention is also able to process packaging containers for perishable goods, particularly food, to be stored inside the sealable container.

Another subject of the present invention is a method of opening, evacuating and sealing a sealable container according to the invention. This method offers the possibility to automatically carry out all steps of opening, evacuating and sealing a sealable packaging container in a series of automatic working steps.

The method comprises the steps of inserting the closed container preferably inside the receptacle provided in the lower part of the machine, subsequently opening the container by lifting off the lid from the tray and/or pulling down the tray, finally evacuating, reclosing and sealing the container.

In a preferred embodiment of the invention the opening means are fixed and the container is moved downwards inside the lower part of the packaging machine. As a result of this relative movement of the tray to the opening means, the opening means lift off the lid from the tray of the container. After opening the atmosphere inside the container is evacuated and, optionally, exchanged by another, preferably inert gas or an inert gas mixture. Finally the sealing means are moved downwards against the backside of the lid's circumferential area and press, subsequently seal the lid's circumferential area onto the tray's circumferential area.

This preferred embodiment provides the opportunity to carry out the method according to the invention by using a minimum number of moved parts of the machine. It is therefore not necessary to carry out a harmonised movement of a plurality of pins, the movement of the receptacle is thus easy to operate.

DESCRIPTION OF THE DRAWING

The invention is explained in detail in FIGS. 1 and 2. The Figures only show distinct embodiments of the invention and do not restrict the inventive idea in any way.

DETAILED DESCRIPTION OF THE INVENTION

Figure 1A:
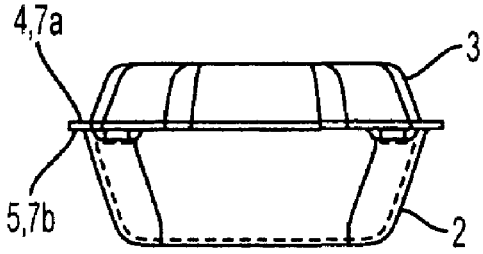
FIG. 1*a* shows a front view, a side view and a top view of a sealable packaging container according to the invention.

In FIG. 1*a* a front view, a side view and a top view of the sealable packaging container 1 is depicted. The container 1 comprises a tray 2 and a lid 3 each having a considerably horizontal circumferential areas 4, 5. The circumferential areas 4, 5 serves at least partially as the sealing areas 7*a*, 7*b*. The container 1 has an essentially rectangular base with four corners, although the skilled person understands that the container and its circumferential areas can have any shape. The corners of the tray 2 and. the lid 3 each are rounded off wherein the radii 8 of tray's corners are bigger than the radii 9 of the lid's corners resulting in parts 20 of the circumferential area 5 of the lid 3 protruding from the circumferential area 4 of the tray 2 i.e. the circumferential area 5 is larger than the circumferential area 4. This results in parts of the lid's 3 corners protruding about the tray's 2 corners and serves as working points for lifting off the lid 3 from the tray 2.

Figure 1B:
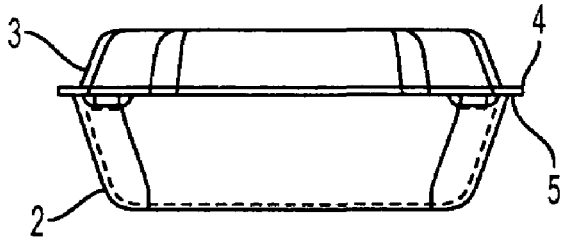
FIG. 1*b* shows a front view and a top view of another embodiment of the sealable packaging container according to the invention.
Figure 1C:
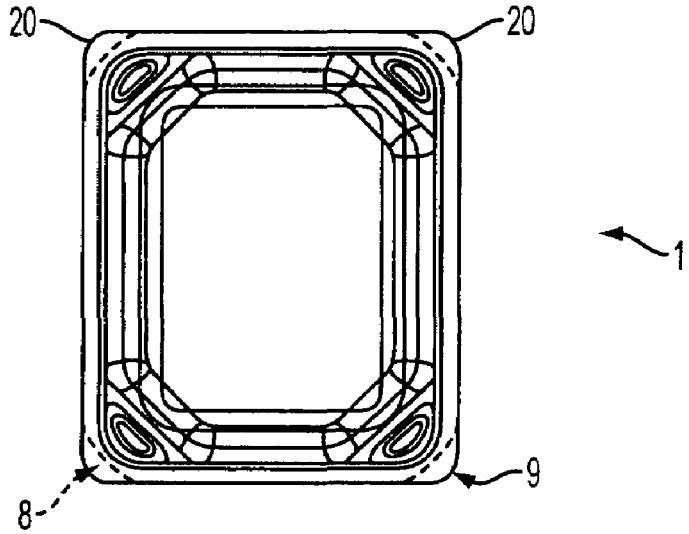
Figure 1D:
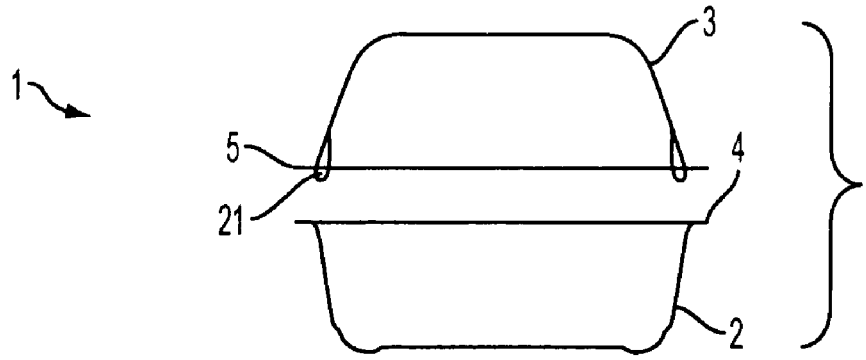
Figure 1E:
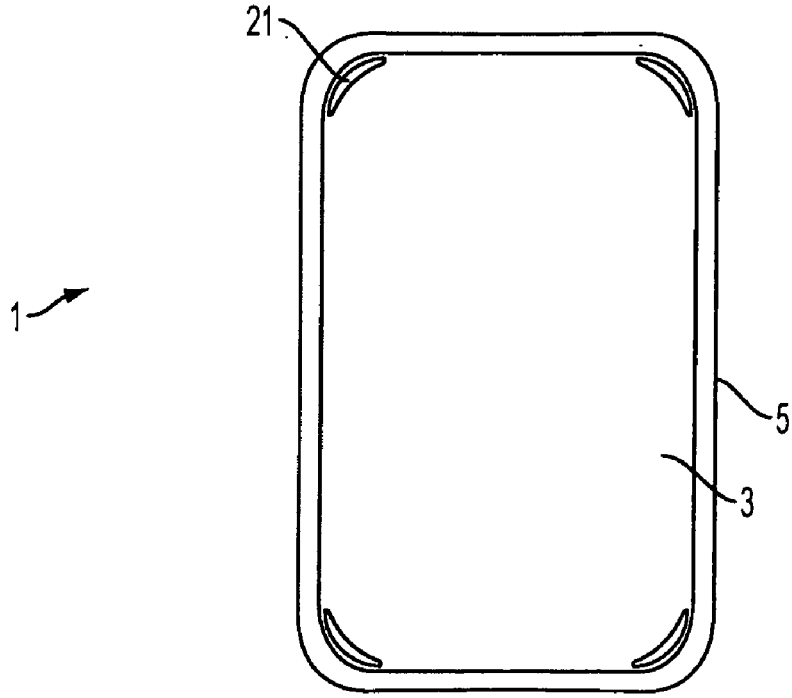

FIG. 1*b* shows a front view and a top view of another embodiment of a sealable packaging container 1 as shown in FIG. 1. The circumferential areas 4, 5 of the container 1 are rectangular and in each corner of the lid 3 a lug 21 is mounted each being pre-stressed in the outward direction to press onto the inner wall of the tray 2. By this design of the container 1 according to the invention the lid 3 is guided on the tray 2 and kept in a defined position even without the lid 3 being sealed onto the tray 2.

Figure 2A:
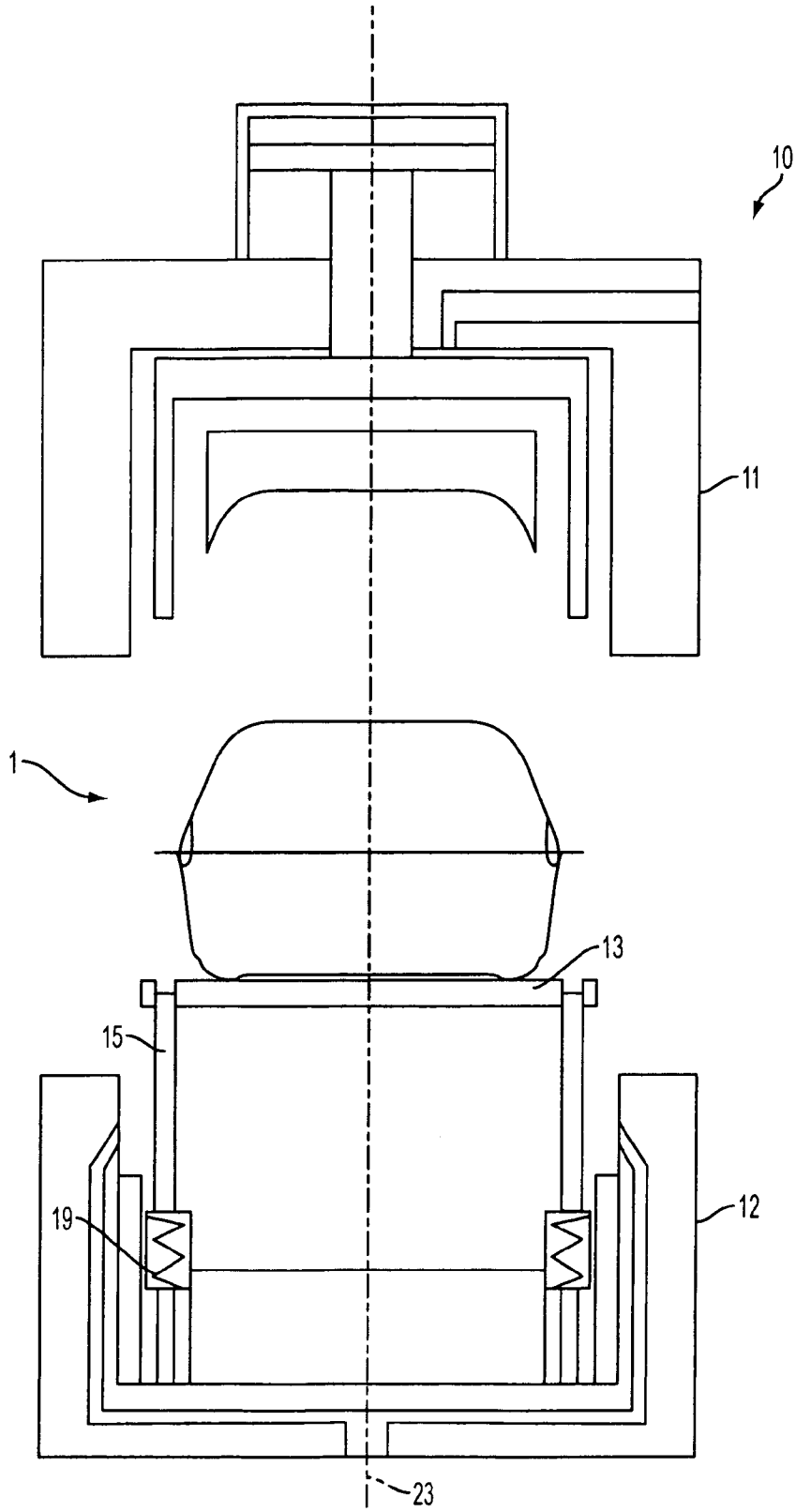
FIG. 2*a* shows a sealable packaging container inserted into the packaging machine according to the invention in a cross sectional side view.

In FIG. 2*a* the first working step inside the packaging machine 10 according to the invention is shown. The packaging machine 10 comprises an upper part 11 and a lower part 12 vertically moveable against each other parallel to the axis 23. The closed and filled container 1 is inserted into the packaging machine 10 and placed on receptacle 13 which itself is part of the lower part 12 of the packaging machine. Around the circumference of the receptacle 13 two of four pins 15 (only two shown) are arranged for opening the container 1. The pins 15 are each mounted on top of springs 19.

Figure 2B:
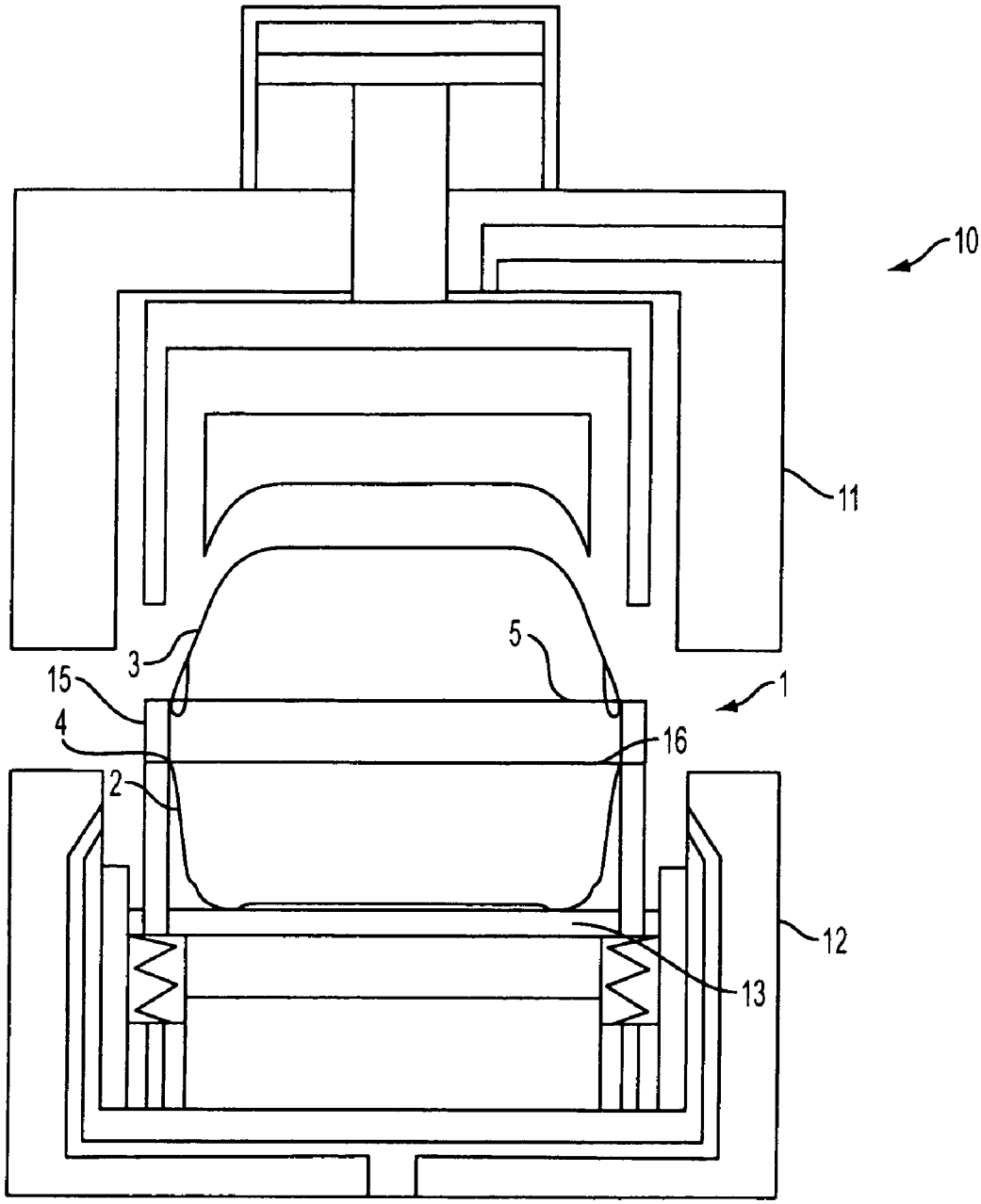
FIG. 2*b* shows the step of lifting off the lid from the tray in a cross sectional side view.

In FIG. 2*b* the second working step carried out by the packaging machine 10 according to the invention is shown. The lower part 12 is vertically moved against the upper part 11 whereby the receptacle 13 carries out a different movement resulting in a relative movement of the tray 2 to the pins 15. When the pins 15 reach the level of the upper edge 16 of the tray, the pins 15 get in contact to the circumferential area 4 of the lid 3 and subsequently lift off the lid 3 from the tray 2.

Figure 2C:
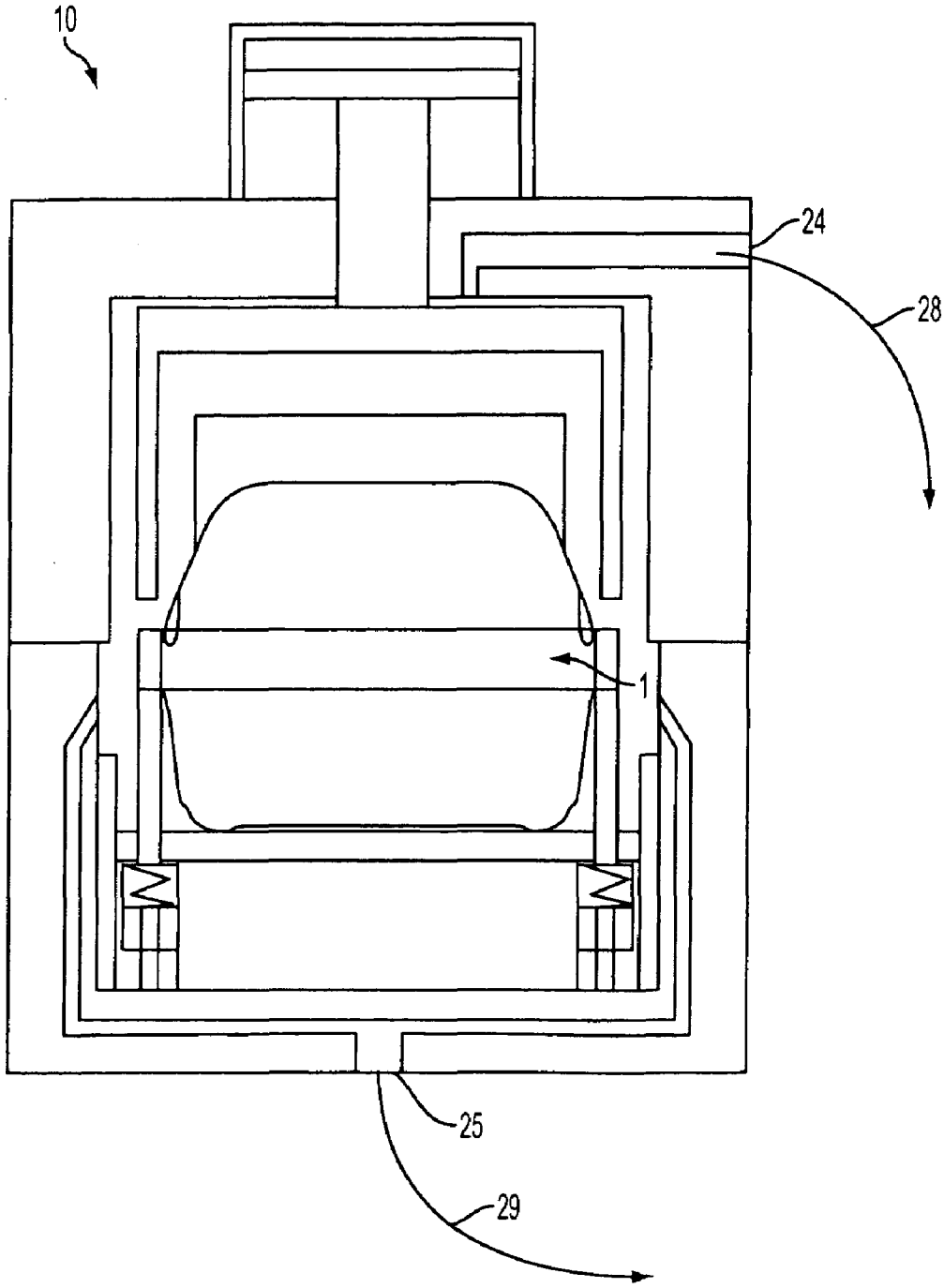
FIG. 2*c* shows the step of evacuating the machine according to the invention in a cross sectional side view.

In FIG. 2*c* the evacuation step is shown. The gas atmosphere inside the machine 10 and the opened container 1 itself is sucked out through openings 24, 25 as shown symbolically by arrows 28, 29.

Figure 2D:
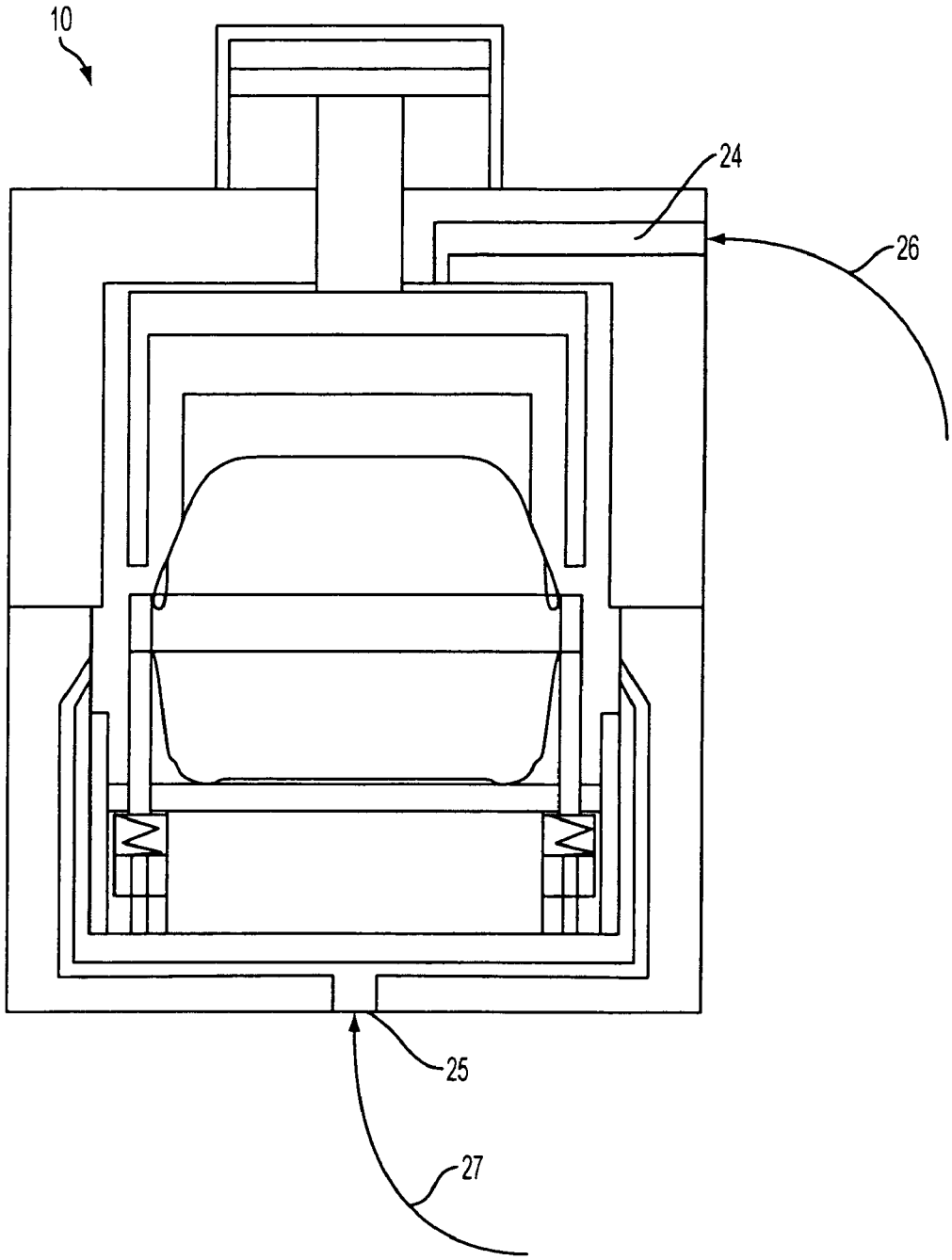
FIG. 2*d* shows the step of refilling an inert gas into the machine according to the invention in a cross sectional side view.

In FIG. 2*d* the working step of gas discharging a gas mixture into the container 1 is pictured. According to the arrows 26, 27 the inert gas is filled into the packaging machine 10 and into the opened container 1 through openings 24, 25.

Figure 2E:
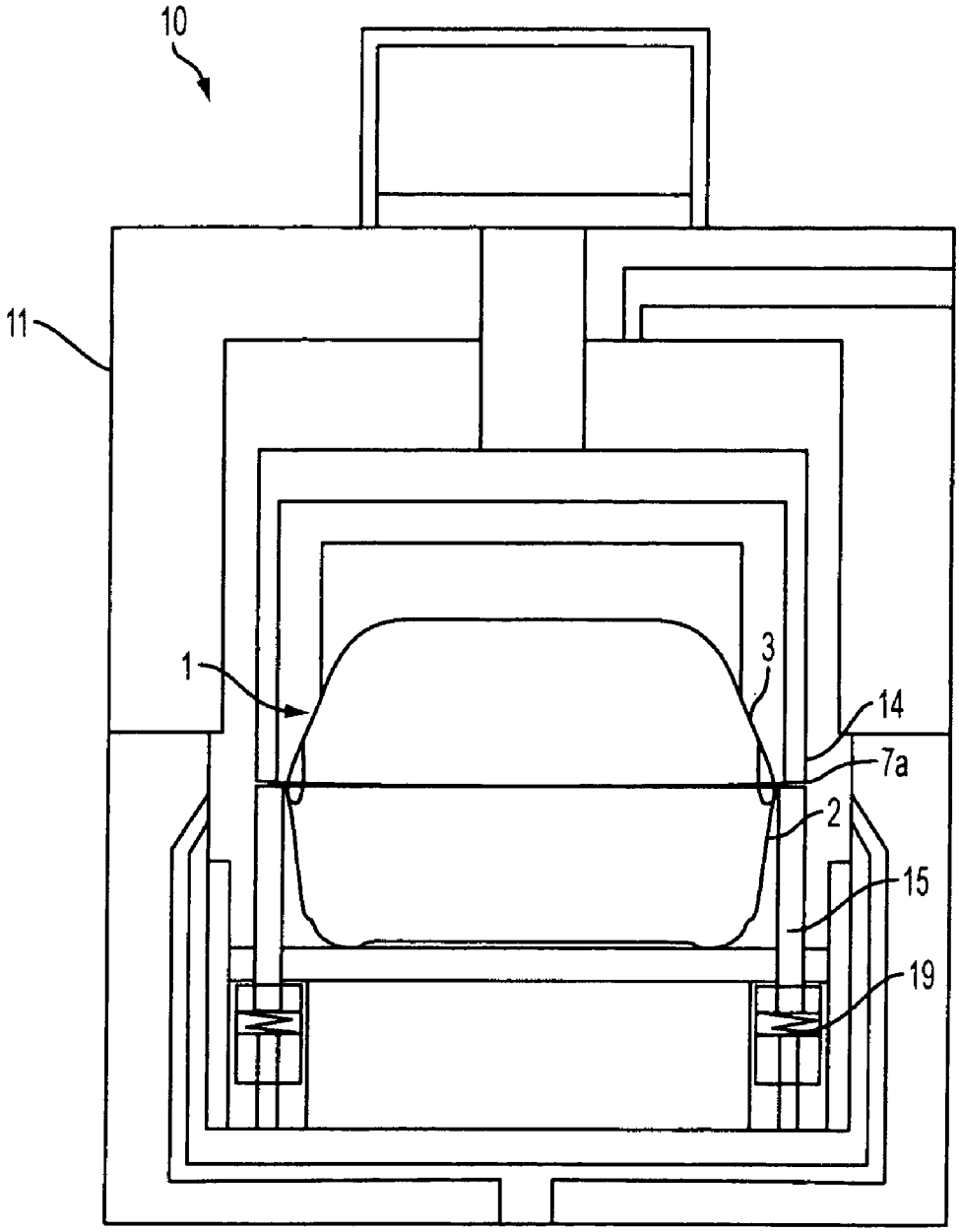
FIG. 2*e* shows the step of sealing the closed packaging container according to the invention in a cross sectional side view.

In FIG. 2*e* the working step of sealing the container 1 is pictured. The lid 3 is pressed onto the tray 2 while upper part of sealing means 14 which are arranged inside the upper part 11 of the machine 10 presses onto the pins 15 and subsequently press down the pins 15 and the springs 19 on which they are mounted. For sealing the container 1 the upper part of the sealing means 14 presses onto a lower part of the sealing means (not shown) arranged around the circumference of the tray's sealing area 7*a*.

LIST OF REFERENCE NUMBERS

1 container
2 tray
3 lid
4 circumferential area of the tray
5 circumferential area of the lid
6 pins
7*a* sealing area of the tray
7*b* sealing area of the lid
8 radius of the tray's corner
9 radius of the lid's corners
10 packaging machine
11 upper part
12 lower part
13 receptacle
14 sealing means
15 opening means
16 upper edge of the tray
17 evacuation means
18 gas exchange means
19 spring elements
20 protruding parts of the lid's sealing area
21 lug
23 centre axis of the packaging machine
24 opening
25 opening
26 arrow
27 arrow
28 arrow
29 arrow

The invention claimed is:

1. Packaging machine for sealing a packaging container, the packaging container having a tray and a lid, the packaging machine comprising:

an upper part and a lower part arranged vertically moveable against each other, the lower part containing a receptacle for holding the tray;

means for evacuation means for sealing the container lower part;

means for opening the container comprising at least three vertically arranged pins, said pins being mounted on springs adapted to urge the pins in an upward motion; and wherein the pins and the receptacle for holding the tray being vertically moveable relative to each other, the pins being located at the horizontal circumference of the tray, so that the upper part of the sealing means, while moving downwards, push the pins downward, against the spring, until the upper part of the sealing means is in operative association with the lower part of the sealing means.

2. The packaging machine according to claim 1, wherein the pins engage the lid for opening the container by lifting the lid from the tray.

3. The packaging machine according to claim 1, wherein the opening means keep the lid in its fixed position while the receptacle is moved downwards.

4. The packaging machine according to claim 1, wherein the container is opened by the opening means lifting off the lid from the tray and the receptacle moving downwards.

5. The packaging machine according to claim 1, wherein the area of lid includes parts that protrude outward from the area of the tray and in that the pins act upon those parts of the area of the lid which protrude from the area of the tray.

6. The packaging machine according to claim 5, wherein the means for opening the container act through openings provided in the circumferential area of the tray.

7. The packaging machine according to claim 1, wherein the means for opening the container comprise four vertically arranged pins located at a horizontal circumference of the tray and which extend, before evacuation, above the tray.

8. The packaging machine according to claim 1 further comprising means for exchanging gas inside the container.

* * * * *